United States Patent [19]

Tillotson et al.

[11] 4,403,466

[45] Sep. 13, 1983

[54] LAWN MOWER ENGINE OIL DRAIN

[75] Inventors: Henry B. Tillotson, Minnneapolis; Richard A. Thorud, Bloomington; James R. Baumann, St. Louis Park, all of Minn.

[73] Assignee: The Toro Company, Minneapolis, Minn.

[21] Appl. No.: 375,421

[22] Filed: May 6, 1982

[51] Int. Cl.[3] ..... A01D 35/26; B67D 5/00; F01M 11/04

[52] U.S. Cl. ..... 56/16.7; 184/1.5; 141/392; 123/196 S

[58] Field of Search ..... 141/18, 21, 98, 392; 184/1.5; 222/539, 533; 56/16.7, 16.8, 16.9; 123/90.53, 90.38, 196 S, 196 W, 196 DA

[56] References Cited

U.S. PATENT DOCUMENTS

| | | | |
|---|---|---|---|
| 1,717,188 | 6/1929 | Ciomci | 184/1.5 |
| 2,216,360 | 10/1940 | Sweetland | 184/1.5 |
| 2,953,939 | 9/1960 | Rains | 184/1.5 |
| 3,103,947 | 9/1963 | Mueller | 184/1.5 |
| 3,181,745 | 5/1965 | Grobowski | 222/539 |
| 3,858,686 | 1/1975 | Laterick | 184/1.5 |

*Primary Examiner*—Gene Mancene
*Assistant Examiner*—John Weiss
*Attorney, Agent, or Firm*—James W. Miller

[57] ABSTRACT

A rotary lawn mower (2) includes a four cycle internal combustion engine (20) having an elongated dipstick tube (30). Dipstick tube ( (30) is pivotably connected to the engine oil sump (24) for movement between a first position and a second horizontal position. Dipstick tube (30) in the second position thereof easily drains oil from the engine oil sump (24).

9 Claims, 4 Drawing Figures

FIG. 1
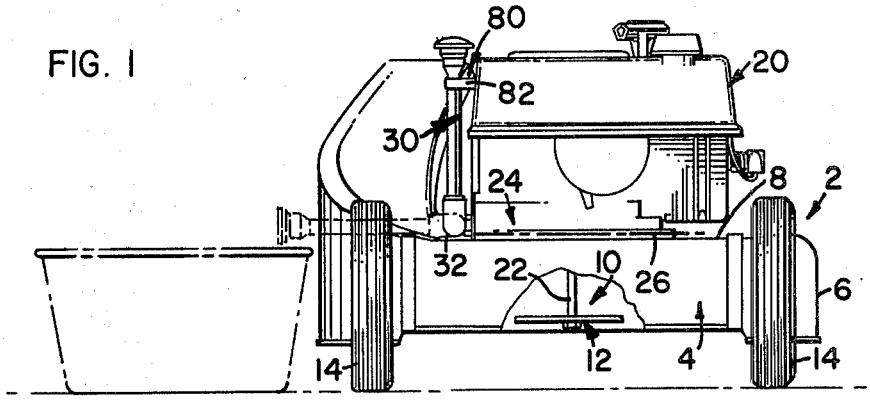
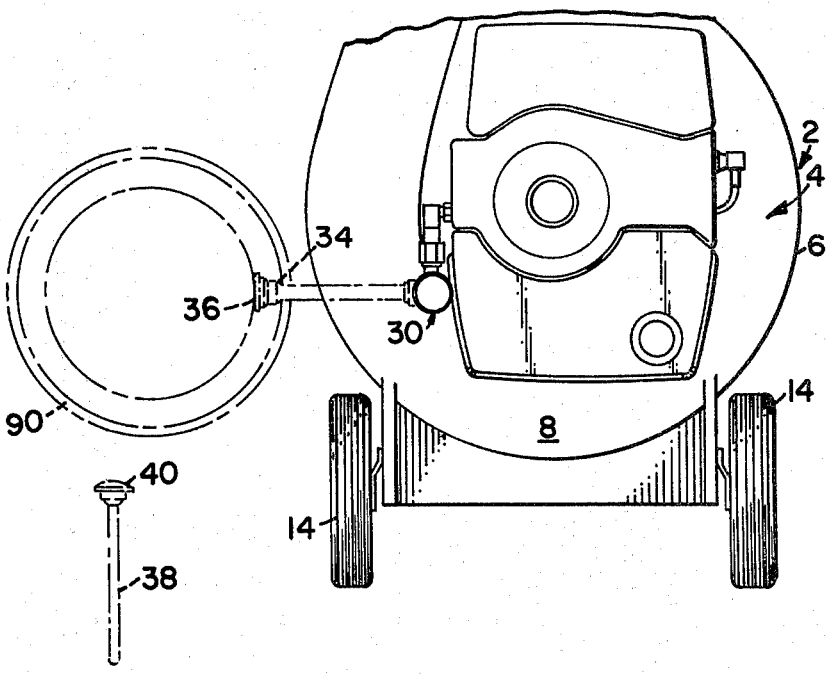
FIG. 2

LAWN MOWER ENGINE OIL DRAIN

TECHNICAL FIELD

This invention relates primarily to rotary lawn mowers and other pieces of outdoor power equipment for mowing ground growing vegetation such as grass or for performing other ground or turf grooming actions. More particularly, this invention relates to such a lawn mower having an internal combustion engine of the four cycle type.

DESCRIPTION OF THE PRIOR ART

Rotary lawn mowers are well known for cutting grass and other ground growing vegetation. Such lawn mowers typically comprise a mower deck or housing movably supported by a plurality of wheels attached thereto. The underside of the mower deck defines a cutting chamber in which a cutting element is contained. An internal combustion engine or other appropriate power source is usually bolted to the top of the mower housing. The drive shaft of the engine extends down into the cutting chamber where it is secured to the cutting element for rotating the cutting element in a substantially horizontal cutting plane.

The internal combustion engines used as power sources on such mowers may be either two cycle or four cycle as desired. Four cycle engines contain the required lubricating oil in a separate oil sump or crankcase. During operation of the engine, this oil reaches all the necessary parts. Four cycle engines are often desired since the operator need not mix the lubricating oil with the gasoline. However, it is usually necessary that the oil be periodically removed from the mower and replaced with fresh oil.

The Toro Company of Minneapolis, Minnesota, the assignee of the present invention, has manufactured and sold a line of rotary lawn mowers utilizing four cycle engines. Such mowers have included an elongated dipstick tube fixed relative to the engine and housing. This tube extends vertically upwardly from the oil sump of the engine. This dipstick tube has an open upper end which is closed by a cap attached to a dipstick which extends down into the tube. When the dipstick and its attached cap are removed, the tube serves as a means for filling the sump with oil. The dipstick also serves as a convenient means for checking the oil level in the sump. However, to empty the sump of oil, an outlet opening has customarily been provided in the bottom of the oil sump. This outlet opening is normally closed by a rotatable screw-threaded plug. This plug when in place is located underneath the mower housing inside the cutting chamber.

While the system just described works satisfactorily, it is somewhat cumbersome in terms of draining the oil from the sump. To drain the oil the operator first has to reach up with his hand into the cutting chamber and locate the threaded plug beneath the housing. Then, the operator has to remove the threaded plug by turning the plug all the while doing so without actually seeing the plug, i.e. by feel. The operator also has to have prepositioned a pan beneath the mower housing for catching the oil as soon as the plug is released. This may be difficult to do if the pan is not of the right size. Moreover, it is difficult and cumbersome to remove the plug only by feel.

Other rotary mowers have been proposed in which an opening into the oil sump is contained above the mower housing. This opening is closed by a screw threaded plug and can serve as both the means for filling and draining the sump. However, to drain the sump, the mower has to be tipped over completely onto its side. Such a procedure is shown in U.S. Pat. No. 3,181,745 to Grobowski in FIG. 6. This is inconvenient and potentially dangerous since the gasoline contained in the engine may be able to spill out when the mower is in this position. If the mower has just been operated so that the engine is still hot, this gasoline could perhaps ignite, thereby causing serious injury. At the least, tipping the mower all of the way over onto its side may be difficult and messy for some operators to accomplish.

SUMMARY OF THE INVENTION

Accordingly, it is an aspect of this invention to provide a means for draining oil from a four cycle engine on a lawn mower which obviates the above noted disadvantages of the prior art. This invention provides a means which easily drains oil from the oil sump of a four cycle engine without having to tip the mower onto its side more than 30° from the horizontal.

This invention relates to an improved lawn mower which includes a housing and means for movably supporting the housing for movement over the ground. A cutting element is carried on the housing for severing ground growing vegetation. An internal combustion engine is carried on the housing for powering the cutting element. The engine includes an oil sump for containing oil. The present invention relates particularly to an outlet opening for the oil sump. This opening is above the lawn mower housing so that the operator can reach a plug closing the opening without having to reach beneath or tilt the housing. This oil outlet is so configured such that it will drain oil from the oil sump when the mower is tilted onto one set of side wheels within 30° or less of a horizontal orientation.

Another aspect of this invention is a lawn mower having the above noted characteristics further including an elongated tube connected to the sump for filling the oil sump with oil. A means is provided for movably connecting this tube to the sump for movement between a first position in which the tube is substantially vertical relative to the housing and a second position in which the tube is approximately horizontal relative to the housing, whereby the tube in its second position drains oil from the oil sump.

BRIEF DESCRIPTION OF THE DRAWINGS

This invention will be described in the following Detailed Description, when taken in conjunction with the following drawings, in which like reference numerals refer to like elements throughout.

FIG. 1 is a front elevational view of an improved lawn mower according to this invention, particularly illustrating in solid lines a first position for an oil dipstick tube which is part of the engine for such a mower and in phantom a second or oil draining position for said tube;

FIG. 2 is a partial top plan view of the lawn mower of FIG. 1;

DETAILED DESCRIPTION

Figure 3:
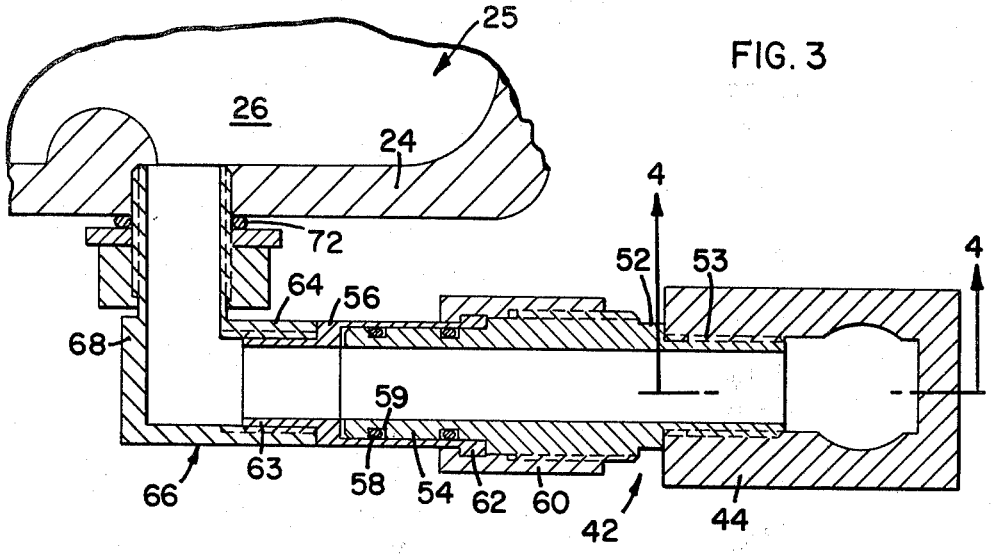
FIG. 3 is a cross-sectional view of a portion of the mower shown in FIG. 1, particularly illustrating the means for pivotably mounting the dipstick tube to the engine oil sump.

Referring first to FIGS. 1 and 2, an improved lawn mower according to the present invention is generally illustrated as 2. Lawn mower 2 includes a mower deck or housing 4 having a downwardly depending skirt 6 and an integrally formed top wall 8. Skirt 6 defines a circumferentially extending peripheral edge of housing 4. A cutting chamber 10 is defined within the skirt 6 of housing 4 beneath top wall 8. A rotatable cutting element 12, such as a rigid steel blade of flexible filament line, is contained in the cutting chamber. A plurality of rotatable wheels 14 are secured to housing 4 for rollably supporting the housing for movement over the ground. Wheels 14 are arranged in pairs on each side of housing 4, i.e. front and back wheels on the right side of housing 4 and another similar pair on the left side of housing 4. The details of lawn mower 4 are not important to the present invention. Any generally conventional rotary lawn mower will be usable with the invention described hereafter.

It is important in the present invention that an internal combustion engine of the four cycle type be used as the power source for rotating cutting element 12. Such an engine is generally shown as 20 herein and includes a downwardly extending drive shaft 22 bolted or otherwise suitably secured to cutting element 12. The engine includes a cylinder having a piston which drives a crankshaft and the drive shaft 22 to thereby rotate the cutting element and sever vegetation. In addition, power from the engine 20 may be used to self-propel the housing if desired. Any suitable four-cycle engine 20 may be used. Engine 20 illustrated herein is a Tecumseh TNT-100.

In any event, engine 20, since it is a four-cycle type, normally comprises or includes an oil crankcase or sump 24. Oil sump 24 is simply a chamber or reservoir 25 in the lower portion of the engine 20 which contains a suitable supply of lubricating oil. During operation of engine 20, the oil contained in sump 24 is pumped throughout engine 20 as necessary to lubricate various components thereof. Sump 24 will have a lowermost portion or point generally identified for purposes of illustration herein as being equal to the elevation of plane 26. If all of the oil is drained from plane 26, then all of the oil will be removed from sump 24.

This invention relates to a means for easily draining oil from sump 24. An important feature of the invention is an elongated dipstick tube 30. Tube 30 has a lower end or base 32 and an open upper end 34. The open face of the upper end 34 defines an open outlet opening 36 for tube 30. An elongated dipstick 38 has a cap 40 secured to one end thereof. Dipstick 38 is sized to be received inside tube 30 with cap 40 normally closing the outlet opening 36 defined by the upper end 34 of tube 30. Any suitable means of releasably securing cap 40 to the upper end 34 of tube 30 may be used, e.g. a screw-threaded attachment or the like. When cap 40 is in position closing the upper end 34 of tube 30, dipstick 38 extends downwardly into the lower end 32 of tube 30 to serve as a means for checking the oil level in sump 24.

Figure 4:
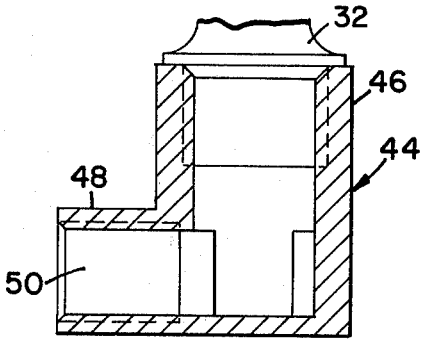
FIG. 4 is a cross-sectional view of the lower end of the dipstick tube taken along lines 4—4 in FIG. 3.

Referring now to FIGS. 3 and 4, a means 42 is provided for pivotally mounting the dipstick tube 30 to engine 20. As shown in FIG. 4, the lower end 32 of dipstick tube 30 is externally threaded. Mounting means 42 includes an L-shaped base member 44 having a first leg 46 which is screwed onto the lower end 32 of dipstick tube 30 and a second leg 48 extending at right angles relative thereto. The second leg 48 of base member 44 includes a horizontal bore 50 which is internally threaded so that it can be threaded onto one end of an inner pivot tube 52. Inner pivot tube 52 has an opposite end 54 which is telescopically received in one end of an outer pivot tube 56. The end 54 of inner pivot tube 52 has two annular grooves 59 each containing an O-ring 58. O-rings 58 effect a liquid seal between the inner and outer pivot tubes 52 and 56. A hydraulic coupling nut 60 is threaded onto the inner pivot tube and has one end which abuts against a shoulder 62 on the outer pivot tube. Hydraulic coupling nut 60 rotatably couples the inner and outer pivot tubes together to allow the tubes to rotate relative to one another without separating.

The opposed second end 63 of the outer pivot tube 56 is threadedly received inside one leg 64 of an L-shaped oil port drain member 66. Drain member 66 has a second leg 68 which is coupled by a nut 70 to an opening in oil sump 24. An O-ring seal 72 is used between nut 70 and sump 24 to prevent leakage therebetween. Leg 68 fluidically communicates by an interior bore with the oil reservoir 25 of the oil sump 24. All of the members of mounting means 42, both the base member 44, inner pivot tube 52, outer pivot tube 56 and oil port drain member 66 have through passageways or bores aligned with one another to fluidically connect the reservoir 25 of oil sump 24 to the interior of dipstick tube 30. Generally, the oil sump 24 will have its lowermost surface 26 at approximately the same elevation as the lower surfaces of the fluid passageways in the members comprising mounting means 42.

In any event, dipstick tube 30 is pivotally secured to the engine by mounting means 42 for movement between a first generally vertical position and a second substantially horizontal position all as shown in FIGS. 1 and 2. The vertical position is shown in solid lines and the lowered or horizontal position in phantom. The pivoting movement of tube 30 is allowed simply by virture of the pivoting of the inner pivot tube 52 within the outer pivot tube 56 since these two members are freely rotatable relative to one another. In addition, some sort of latch 80 may be made as a part of the engine housing for releasably retaining the dipstick tube 30 in its upper or raised position. This latch 80 may comprise an open U-shaped spring type clamp 82 or any other suitable retaining means.

In the operation of the invention, dipstick tube 30 is normally held in its vertical position when filling the engine oil sump with oil or during operation of the mower. In this position, to fill the sump with oil, one need only remove the dipstick 38 from tube 30 and then pour oil down through the tube 30 into the sump. Dipstick 38 is then replaced and operation of mower 2 can commence. However, at some predetermined time, usually judged by the number of hours of operation of the engine 20, it is required that the dirty engine oil be removed and replaced with clean oil.

To drain engine oil from the sump 24, all that is required is that the operator first remove the engine dipstick 38 from the tube 30, unlatch the tube 30 from the spring clamp 82 by pulling the tube outwardly away from the engine with sufficient force, and then pivot the dipstick 38 down to its lowered horizontal position. In this position, it is seen that the length of the tube 30 has been selected so that the outer outlet opening 36 of the tube is located past the peripheral edge of housing 4. See FIG. 1 and 2. A pan 90 or other similar receptical may then be placed beneath the end 34 of tube 30. Oil will then flow from the sump 24 through the tube 30 and outwardly into pan 90. It is preferred that the lowermost surface 26 of the sump be slightly higher than the outlet opening 35 of the tube when the tube is in its lowered position. Thus, oil will drain from the sump through the tube and out into the pan simply by the force of gravity without having to tilt or otherwise manipulate the mower housing.

While the preferred form of the invention contemplates oil drainage through tube 30 without any tilting of mower housing 4, this is not strictly necessary for use of the present invention. For example, in the case where the second position of tube 30 is substantially horizontal and the lowermost surface 26 of oil sump is at about the same level, or where the lowermost surface 26 is extremely irregular, it may be necessary to slightly tilt the mower onto one set or pair of its side wheels 14 to completely drain all the oil in the sump out through the tube. However, this invention contemplates a configuration in which the degree of tilt required in the latter event would very slight, i.e. 30° or less from horizontal. Thus, there is no risk of spilling gasoline or the like from the engine with such a small degree of tilt. Moreover, it is relatively easy for any operator to tilt the mower housing through such a small amount of tilt simply by grabbing onto the handles provided as part of the lawn mower housing and tipping the mower to one side. In fact, blocks or the like can be placed under the wheels during the engine draining operation to maintain the tilt at a constant level.

The present invention provides a particularly easy and effective means for draining oil from a four cycle engine used on a lawn mower. It can be done by an operator without having to manipulate any hidden plugs on the underside of the mower housing and without having to totally tip the mower onto its side. Thus, the dip-stick tube can be easily manipulated by either relatively young or weak operators with little effort. The amount of tipping of the mower which is required is so slight as to be easily capable of by these same operators. Accordingly, this invention yields a particularly unique and effective mens for performing a relatively unpleasant task relating to mower maintenance.

The present invention can also be considered more broadly than simply a pivoting dipstick tube 30 secured to an engine 20. The dipstick tube 30 also defines an outlet opening 35 into the oil sump 24 which opening is located generally above the mower housing so that an operator can easily reach this outlet opening without having to reach beneath the mower housing or invert the mower housing in the case of some examples of the prior art. Dipstick 38 and attached cap 40 then represent a plug member which selectively covers the outlet opening 35. The outlet opening is located relative to the engine oil sump so that when this plug member is removed substantially all of the oil can be drained from the engine oil sump by tilting the mower housing onto one of its pairs of side wheels within 30° or less from the horizontal.

Various modifications of this invention will be apparent to those skilled in the art. For example, while the length of the dipstick tube 30 has been shown as being sufficient to extend past the peripheral edge of housing 4, this is not strictly necessary. The dipstick tube could be shorter so that even in its second or horizontal position its outlet opening 35 is inboard of the peripheral edge of the housing. Since oil would then pour into the housing during the draining operation, a trough or other groove in the housing 4 could be formed to receive this oil from the tube and conduct it to the peripheral edge. In addition, while the pivoting dipstick tube 30 of this invention has been disclosed for use on a lawn mower, it could also be used on many other pieces of outdoor power equipment having a four cycle engine. For example, such a pivoting dipstick could be used on various riding mowers, snow throwers, garden tillers, lawn vacuums and the like. All that would be required in any such application is that the dipstick be capable of being pivoted to a lower oil draining position with the oil being somehow conducted conveniently past the housing or to any other suitably placed oil draining receptacle. Accordingly, the scope of this invention is to be limited only by the appended claims.

We claim:

1. An improved lawn mower, which comprises:

(a) a housing;

(b) means for movably supporting the housing for movement over the ground;

(c) a cutting element carried on the housing for severing ground growing vegetation;

(d) an internal combustion engine carried on the housing for powering the cutting element, the engine having an oil sump for containing oil and an elongated tube connected to the sump for filling the sump with oil; and (e) means for movably connecting the tube to the sump for movement between a first position in which the tube is substantially vertical relative to the housing and a second position in which the tube is substantially horizontal relative to the housing, whereby the tube in its second position enables the easy draining of oil from the sump.

2. An improved lawn mower as recited in claim 1, wherein the housing includes an outer peripheral edge, wherein the tube includes an outlet end through which the oil passes when draining from the sump, and wherein the tube is sufficiently long so that in its second position the outlet end of the tube is located radially outwardly past the peripheral edge of the housing.

3. An improved lawn mower as recited in claim 1, wherein the tube has an open outlet end and further including a dipstick for insertion into the tube, wherein the dipstick includes a cap for closing the outlet end of the tube whenever the dipstick is received in the tube.

4. An improved lawn mower as recited in claims 1 or 3, further including means for releasably retaining the tube in its first position relative to the housing.

5. An improved lawn mower as recited in claim 1, wherein the tube is pivotally connected to the oil sump for effecting the movement relative thereto.

6. An improved lawn mower as recited in claim 5, wherein the oil sump includes an outer pivot member fixedly secured thereto and the tube includes an inner pivot member fixedly secured thereto, wherein the inner pivot member is telescopically received in the outer pivot member for free rotation relative thereto to allow the pivoting of the tube relative to the housing, and further including means for effecting a liquid seal between the inner and outer pivot members.

7. An improved lawn mower, which comprises:

(a) a housing;

(b) means for movably supporting the housing for movement over the ground;

(c) a cutting element carried on the housing for severing ground growing vegetation;

(d) an internal combustion engine carried on the housing for powering the cutting element, the engine having an oil sump for containing oil and an elongated tube having an open outlet end connected to the sump for filling the sump with oil; and (e) means for movably connecting the tube to the sump for movement between a first position in which the outlet end of the tube is located above the oil sump so that the oil is retained in the sump and a second position in which the outlet end is located approximately at or below the lowest level of the sump so that oil may drain from the sump through the tube and out through the outlet end thereof.

8. An improved outdoor power equipment unit, which comprises:

(a) a housing;

(b) an active element carried on the housing for performing a ground or turf grooming action;

(c) an internal combustion engine carried on the housing for powering the cutting element, the engine having an oil sump for containing oil and an elongated tube having an open outlet end connected to the sump for filling the sump with oil; and (d) means for movably connecting the tube to the sump for movement between a first position in which the outlet end of the tube is located above the oil sump so that the oil is retained in the sump and a second position in which the outlet end is located approximately at or below the lowest level of the sump so that oil may drain from the sump through the tube and out through the outlet end thereof.

9. An improved outdoor power equipment unit as recited in claim 8, wherein the tube is pivotably connected to the sump for movement between the first and second positions with the first position being substantially vertical and the second position being substantially horizontal.

* * * * *